US006299457B1

(12) United States Patent
Snyder

(10) Patent No.: US 6,299,457 B1
(45) Date of Patent: Oct. 9, 2001

(54) ELECTRICAL CONNECTION DEVICE AND ELECTRONIC INSTRUMENT USING IT

(75) Inventor: Matthew Snyder, Tokyo (JP)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/422,184

(22) Filed: Oct. 22, 1999

(30) Foreign Application Priority Data

Oct. 23, 1998 (JP) ..... 11-303104

(51) Int. Cl.[7] ..... H01R 12/00
(52) U.S. Cl. ..... 439/66
(58) Field of Search ..... 439/66, 86, 591, 439/840

(56) References Cited

U.S. PATENT DOCUMENTS 4,858,074 * 8/1989 Mallet et al. ..... 361/388
5,504,940 * 4/1996 Hahs, Jr. et al. ..... 455/38.1
5,602,490 * 2/1997 Blumenau ..... 324/754

FOREIGN PATENT DOCUMENTS 7-161416A * 6/1995 (JP) ..... H01R/13/22

* cited by examiner

*Primary Examiner*—Tulsidas Patel
(74) *Attorney, Agent, or Firm*—Antonelli, Terry, Stout & Kraus, LLP

(57) ABSTRACT

To provide a low-cost electrical connection device which achieves lowering of the profile of an electronic instrument main body and prevents the occurrence of chattering [sic] and an electronic instrument using this device. A holding section which opens extending from an LCD holder which holds an LCD and is mounted on a circuit substrate is provided, there is provided an insulation element made of soft resin which is press-fitted in this holding section, is fixed and held by a retention portion and retention portions, is located between the circuit substrate and a speaker and absorbs impact such as vibration, etc. which is imposed from the exterior, and there is provided a pair of coil springs which pass through and are held by the insulation element and electrically connect the terminal portions of the circuit substrate and the terminal portions of the speaker.

11 Claims, 10 Drawing Sheets

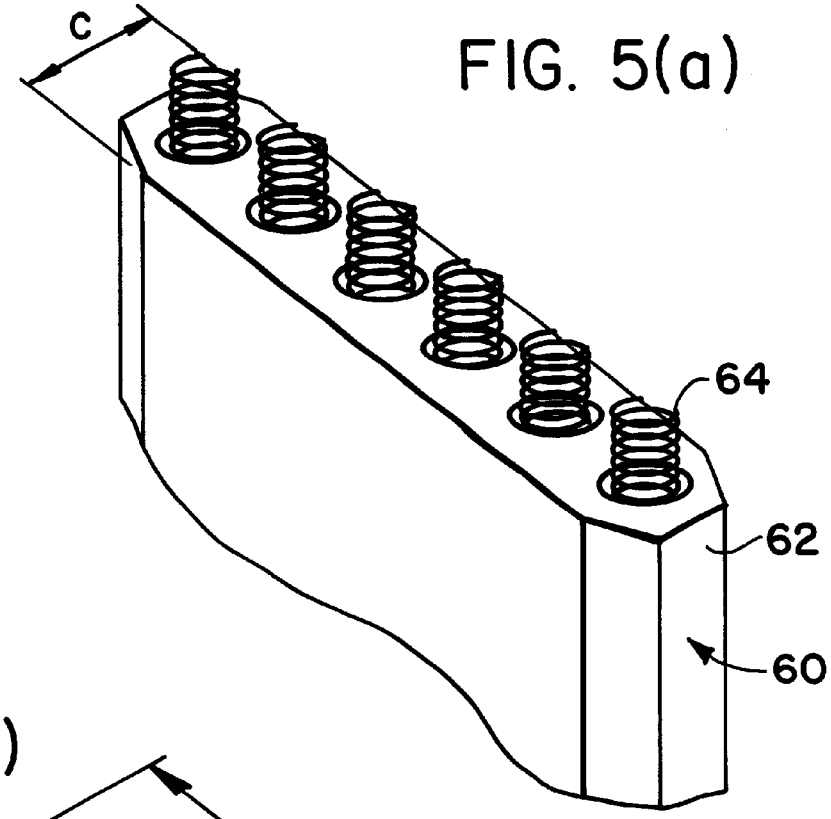
FIG. 5(a)
FIG. 5(b)
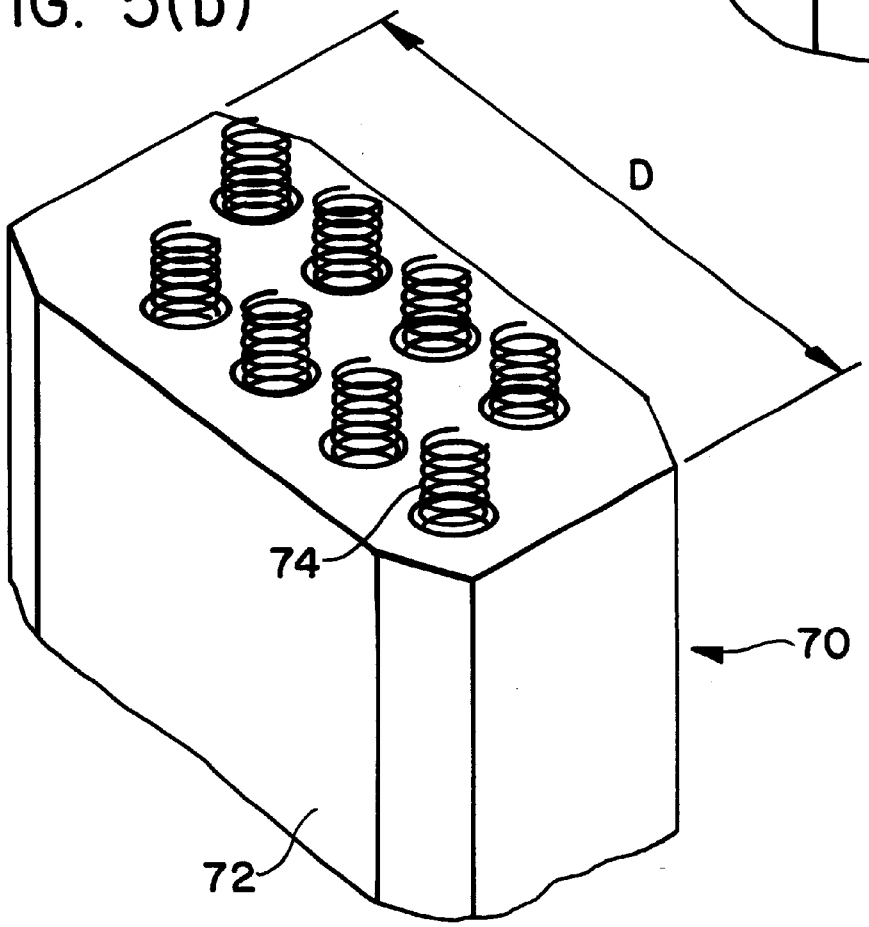

ELECTRICAL CONNECTION DEVICE AND ELECTRONIC INSTRUMENT USING IT

REFERENCE TO RELATED APPLICATION

This application claims the priority right under 35 U.S.C. 119, of Japanese Patent Application No. Hei 11-303104 filed on Oct. 23, 1998, the entire disclosure of which is incorporated herein by reference.

DETAILED DESCRIPTION OF THE INVENTION

1. Field of the Invention

The present invention relates to an electrical connection device and an electronic instrument in which this device is used. More particularly, the invention relates to an electrical connection device by which the terminal portions of a 1st electronic part and a 2nd electronic part which are accommodated inside an electronic instrument are electrically connected and to an electronic instrument in which this device is used.

2. Description of the Related Art

A circuit substrate on which plural set electronic parts are mounted is accommodated inside an electronic instrument. Plural external parts such as, eg, a subsidiary substrate, a power source, a display unit and switches, etc. are connected to this circuit substrate from the exterior. However, when external parts are to be connected to the circuit substrate, it is difficult to effect connection by means of wires after the circuit substrate has been housed in a case of an electronic instrument. Further, if housing in an electronic instrument case is effected after external parts have been soldered to the circuit substrate using wires, it sometimes happens that the soldered portions are pulled and become detached. In such situations, it has been common practice in the past to use electrical connection devices such as connectors or connection terminals, etc. for the purpose of connecting circuit substrates and external parts.

FIG. 6 is a perspective view which shows an electrical connection device which connects a circuit substrate and a subsidiary substrate by means of such conventional connectors. As shown in FIG. 6, an electrical connection device 80 which connects a circuit substrate 82 and a subsidiary substrate 84 by means of conventional connectors comprises a female connector 80*b* which is mounted on the subsidiary substrate 84, and a male connector 80*a* which is mounted on the circuit substrate 82. The circuit substrate 82 on which the male connector 80*a* is mounted is accommodated and fixed in an electronic part case 86. Thus, electrical connection to the circuit substrate 82 can be effected by means of the female connector 80*b* even after the circuit substrate 82 has been housed in the electronic part case 86.

However, with an electrical connection device using conventional connectors such as these, there is the drawback that lowering of the manufacturing efficiency is caused, since the subsidiary substrate 84 moves in the directions of the arrows indicated in FIG. 6, and it is not easy to fit the female connector 80*b* of the subsidiary substrate 84 together with the male connector 80*a* of the circuit substrate 82.

Also, with this electrical connection device using conventional connectors, there is the drawback that a set installation space is needed between the subsidiary substrate 84 and the circuit substrate, and so it is difficult to achieve compactness and a low profile for the electronic part main body. In particular, lower profiles and greater compactness have been demanded for portable mobile telephone, PHS and similar mobile communications terminals in recent years, and lower profiles and greater compactness are therefore also demanded for electrical connection devices.

Electrical connection devices, in which the installation space is made flatter by using resilient elements and compressing them from opposite ends and electronic parts are electrically connected by the urging force of these resilient elements, are commonly used in order to eliminate drawbacks such as the above. FIG. 7–FIG. 10 are perspective views which show structures in which conventional electrical connection devices using such resilient elements are employed for portable mobile telephones, FIG. 7 showing an electrical connection device which uses resilient elements in the form of connection terminals, FIG. 8 another electrical connection device which uses resilient elements in the form of connection terminals, FIG. 9 an electrical connection device which uses a resilient element constituted by a coil spring, and FIG. 10 an electrical connection device which uses a resilient element in which electrically conductive portions and resilient portions are stacked.

As shown in FIG. 7, a conventional electrical connection device 90 in which resilient elements in the form of connection terminals are used comprises connection terminals 90*b*, which have one end mounted (not shown in the drawing) on a circuit substrate 92 and whose other ends are urged in the vertical direction, and a trunk portion 90*a* which holds these connection terminals 90*b*. This electrical connection device 90 is mounted on the circuit substrate 92, and is so installed that, when the circuit substrate 92 is fitted in a case 96 of a portable mobile telephone, the connection terminals 90*b* project from an opening portion 96*a* which is provided in the case 96. Therefore, electrical connection between the connection terminals 94*a* of a battery pack 94 and the connection terminals 90*b* of the circuit substrate 90 can easily be established by fitting the battery pack 94 on the case 96.

Apart from the electrical connection device 90 using connection terminals such as these, there is an electrical connection device 100 which, as shown in FIG. 8, comprises a holder 100*a* which is fitted on a circuit substrate 102, and connection terminals 100*c* which are supported by the holder 100*a*. In this case, the holder 100*a* is formed to the general shape of an open box for the purpose of fitting it on the circuit substrate 102, and a projecting circular rib 100*b* is integrally formed on the upper surface of this generally open-box shape. Further, a portion of the rib 100*b* of the holder 100 is cut out, and the connection terminals 100*c*, which extend to the circuit substrate 102 via this cut-out portion, are fitted on. The connection terminals 100*c* are soldered at one end to a set pattern of the circuit substrate 102, and they are so installed that their other ends are located at the interior of the rib 100*b* and are bent to a set angle and urged in the vertical direction. Therefore, when a microphone 104 is press-fitted into the rib 100*b* of the holder 100*a*, it is fixed, and, at the same time, its terminal portions 104*a* are electrically connected by coming into contact with the connection terminals 100*c*. Thus, the microphone 104 can easily be fitted on and electrically connected to the circuit substrate 102 even after the circuit substrate 102 has been fitted in a case (not shown) of a portable mobile telephone.

Apart from electrical connection devices using such connection terminals, there is a conventional electrical connection device 110 which uses a resilient element constituted by a spring, and in which, as shown in FIG. 9, there is provided a hollow holder 110*a* which has a generally cylindrical shape and in whose interior a coil spring 110*b* is inserted, and there is provision of an upper terminal 110*c* and a lower terminal 110*d,* which are respectively urged by opposite ends of this coil spring 110*b*. This electrical connection device 110 using a spring is so arranged that, when a circuit substrate and a subsidiary substrate such as shown in FIG. 6 are to be electrically connected, electrical connection can easily be established by an action in which, as illustrated in FIG. 9, the terminal portions 112*a* and 114*a* of a circuit substrate 112 and a subsidiary substrate 114 are respectively brought into contact with the upper terminal 110*c* and lower terminal 110*d* at opposite ends of the electrical connection device 110 and pressed. Thus, electrical connection can be effected more easily with the electrical connection device 110 shown in FIG. 9 than it can with the electrical connection device using the connectors shown in FIG. 5.

Further, there is an electrical connection device 120 in which, as shown in FIG. 10, use is made of a resilient element in which plural electrically conductive portions 120*a* and resilient portions 120*b* are alternately overlaid and stacked. This electrical connection device 120 is supported by an LCD holder 123 of an LCD 124 which is fitted to a portable mobile telephone case 126, and it is installed in a manner such that it contacts the terminal portion 124*a* of the LCD 124. The LCD holder 123 on which the LCD 124 and terminal portion 124*a* are mounted is fitted to the portable mobile telephone case 126, and, as the result of the further mounting of a circuit substrate 122, the electrical connection device 120 is pressed between the LCD 124 and the circuit substrate 122 and electrical connection can be established.

Thus, as the result of the interposition of resilient elements between the terminal portions of electronic parts and circuit substrates as illustrated in FIG. 7–FIG. 10, conventional electrical connection devices achieve electrical connections and the lowering of profiles, and at the same time they reduce electronic part production times and so improve production efficiency.

However, with conventional electrical connection devices, since the structure is one in which an electronic part and a circuit substrate are electrically connected by the urging force of resilient elements, there is the drawback that, if impact such as that of vibration, etc. is imposed on the main body of the electronic part, it is transmitted to the resilient elements and the phenomenon of chattering is caused.

If the urging force of the resilient elements is increased in order to prevent occurrence of the phenomenon of chattering, there is the drawback that the resilient elements have a larger shape and so it is difficult to make the electronic part main body thin.

Also, in conventional electrical connection devices, the shape is complex, and the electrical connection device shown in FIG. 10 in particular has a structure in which plural layers are stacked, with the consequent drawback that the manufacturing cost becomes extremely high.

SUMMARY OF THE INVENTION

The present invention has as its object to resolve the above problems and to provide a low-cost electrical connection device and an electronic instrument using this device with which a low profile for the electronic part main body is achieved, and the phenomenon on chattering is prevented.

In order to resolve the problems noted above, the electrical connection device according to the invention which electrically connects the terminal portions of a 1st electronic part and a 2nd electronic part comprises an insulation element which is held by a set holding member, and a conductor which is in the shape of a coil and possesses resilience, which passes through and is held by the insulation element, and which electrically connects the 1st electronic part and 2nd electronic part as the result of being brought into contact and pressed from opposite ends.

Preferably, the insulation element here is formed from soft resin, contacts the 1st and 2nd electronic parts and absorbs vibration. Also, preferably, one out of the 1st and 2nd electronic parts is a circuit substrate and the other is an electronic part. Further, preferably the holding member which holds the insulation element is provided extending from a holder which holds the other electronic part. Also, preferably, plural conductors are passed through and held by the insulation element and are disposed either in zigzag form or in a straight line relative to the insulation element.

The electronic instrument using the electrical connection device according to the invention comprises an electrical connection device which is constituted by a conductor which has a coil shape and possesses resilience being passed through and held by an insulation element and is installed as the result of the insulation element being held by a set holding member, a 1st electronic part which contacts and presses a terminal portion at one end of the conductor of this electrical connection device and a 2nd electronic part which contacts and presses a terminal portion at the other end of the conductor of the electrical connection device.

Preferably, the electronic instrument here is a mobile communications terminal, and the insulation element is formed from soft resin, contacts the 1st and 2nd electronic parts and absorbs vibration. Also, preferably, one out of the 1st and 2nd electronic parts is a circuit substrate and the other is an electronic part. Further, preferably, the holding member which holds the insulation element is provided extending from a holder which holds the other electronic part, and plural conductors are passed through and held by the insulation element.

BRIEF DESCRIPTION OF THE DRAWINGS

FIG. 5 is a perspective views showing other forms of implementation of the electrical connection device according to the invention;

DETAILED DESCRIPTION OF THE PREFERRED EMBODIMENTS

Figure 1:
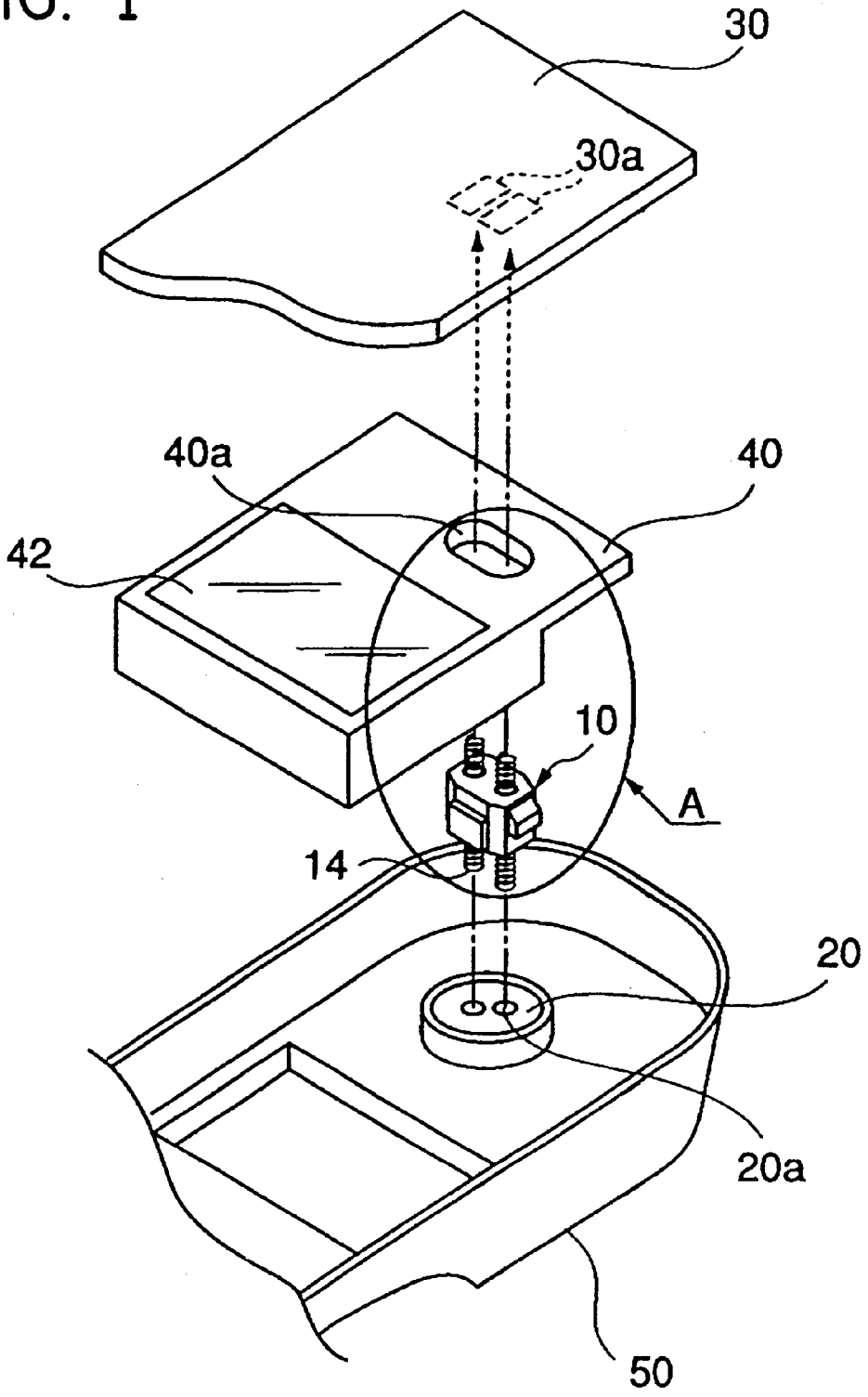
FIG. 1 is a perspective view showing a form of implementation of the electrical connection device according to the invention.
Figure 2:
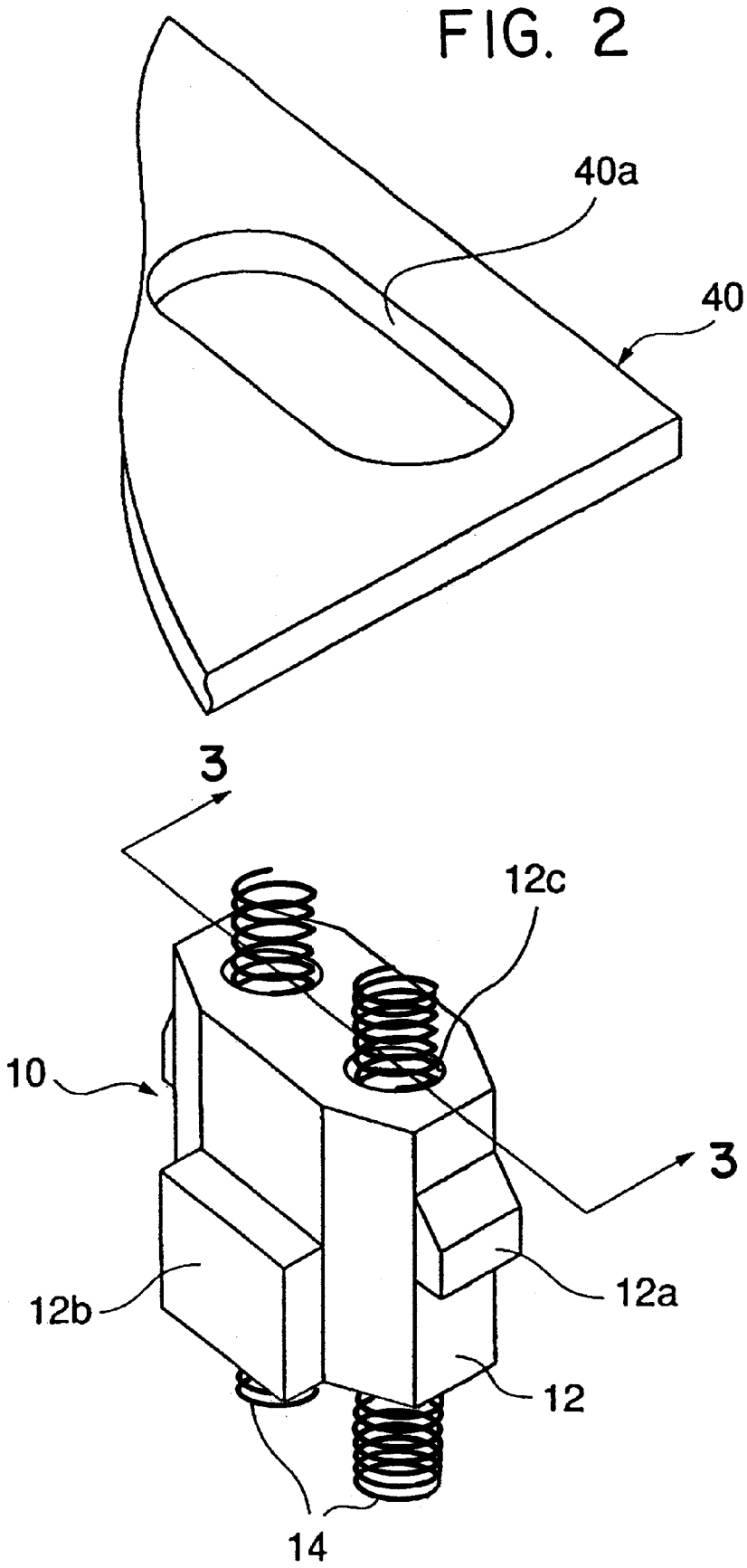
FIG. 2 is an enlarged view showing details of portion A indicated in FIG. 1.
Figure 3:
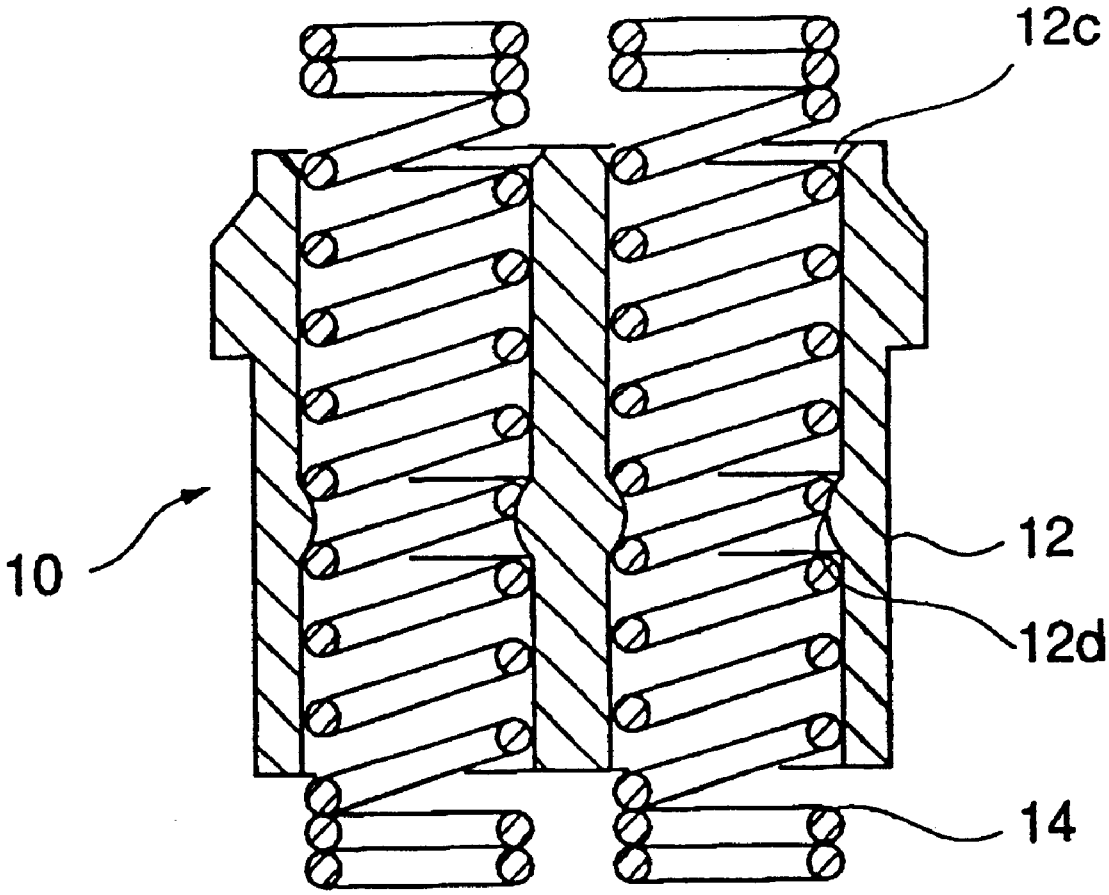
FIG. 3 is a cross-sectional view showing the cross section along the line B—B indicated in FIG. 2.
Figure 4A:
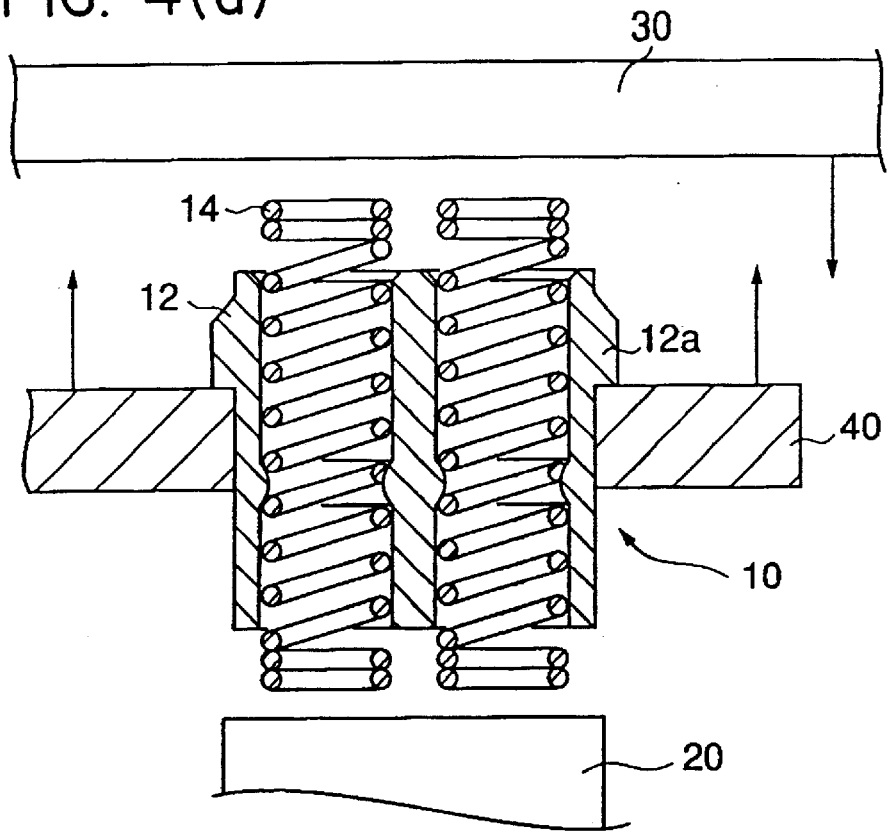
FIG. 4 is a cross-sectional views illustrating actions when the electrical connection device shown in FIG. 1 is fitted in the case of a portable mobile telephone.
Figure 4B:
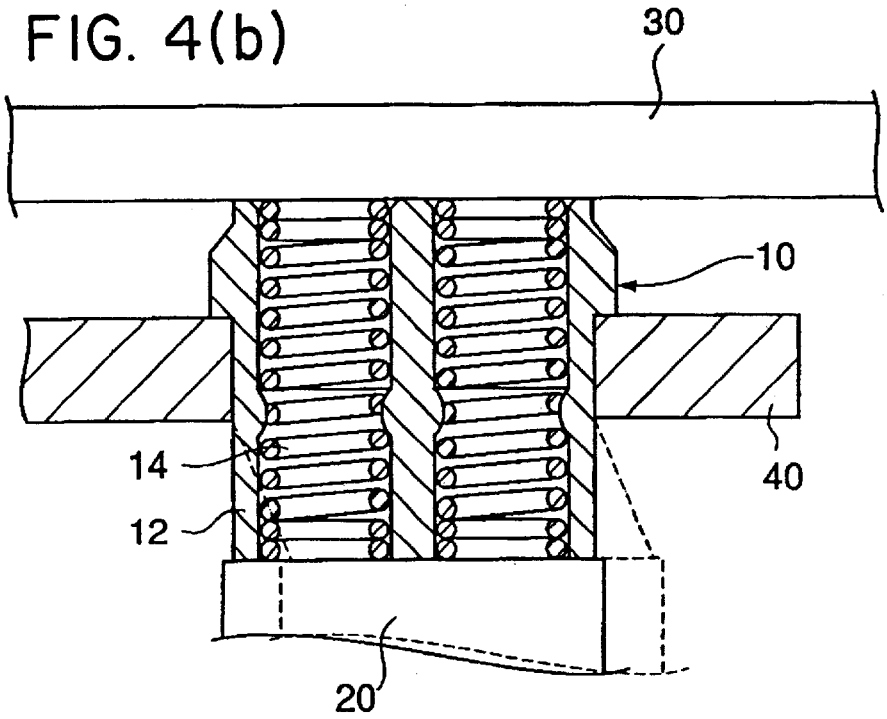

Next, a detailed description of forms of implementation of the electrical connection device according to the invention and an electronic instrument using this device will be given with reference to the attached drawings. FIG. 1 is a perspective view which shows a form of implementation in which the electrical connection device according to the invention is used for a portable mobile telephone. FIG. 2 is an enlarged view showing details of the portion A indicated in FIG. 1. FIG. 3 is a cross-sectional view which shows the cross section along the line B—B indicated in FIG. 2. FIG. 4 shows cross-sectional views in illustration of actions at the time when the electrical connection device shown in FIG. 1 is mounted in the case of a portable mobile telephone, FIG. 4(*a*) showing the state before mounting, and FIG. 4(*b*) the mounted state.

As shown in FIG. 1, the electrical connection device 10 according to the invention is provided in a manner such that it can be press-fitted in a holding section 40*a* which is opened in a set surface which extends from an LCD holder 40. The LCD holder 40, which carries the electrical connection device 10 and an LCD 42, is fitted and fixed to a set surface of a circuit substrate 30. At this time, the LCD holder is fitted to the circuit substrate 30 in a manner such that a pair of coil springs 14 which pass through and are held by the internal portion of the electrical connection device 10 come into contact with terminal portions 30*a* which are formed on the surface of the circuit substrate 30. Further, the circuit substrate 30 to which the LCD holder 40 and electrical connection device 10 have been fitted is mounted in the case 50 of a portable mobile telephone. The case 50 here has mounted therein a speaker 20 which has terminal portions 20*a* projecting towards the direction from which the circuit substrate 30 is mounted. As the result of this arrangement, the electrical connection device 10 brings the other ends of the coil springs 14 which pass through and are held by the internal portion into contact with the terminal portions 20*a* of the speaker 20, and the coil springs 14 are pressed from opposite ends. Thus, the electrical connection device 10 according to the invention is so provided that, as the result of a set electronic part being installed in the case of a portable mobile telephone, electrical connection between the electronic part and a circuit substrate is easily established.

Next, the structure of the electrical connection device 10 according to the invention will be described in detail with reference to FIG. 2 and FIG. 3. As shown in FIG. 2, the electrical connection device 10 according to the invention is constituted by an insulation element 12, which is made of soft resin, and the pair of coil springs 14, which pass through and are held by the internal portion of this insulation element 12. Preferably, the soft resin constituting the insulation element 12 here is constituted by, eg, Mitsubishi Chemical SJ4400B-N RABALON 45° material. Also, preferably, the coil springs 14 which pass through and are held by the internal portion of the insulation element 12 are formed from, eg, SWP-B (piano wire) $\phi$0.18 mm material and are given Ni or Au plating treatment.

The insulation element 12 is formed by plastic injection moulding technique, and, as shown in FIG. 2, it has a generally cylindrical shape, and retention portions 12*a*, which project perpendicularly from opposite side surfaces, and a retention portion 12*b*, which, further, projects in a box shape in the direction which is at right angles to the directions in which the retention portions 12*a* project, are integrally formed. Further, cylindrical through-holes 12*c* which pass through from the top portion to the bottom portion are formed in two places in the insulation element 12. On the inner walls of these through-holes 12*c*, there are formed projections 12*d*, which project in the approximately midway portions of the through-holes 12*c*, as shown in FIG. 3. These projections 12*d* are provided in order to engage the coil springs 14, which are inserted in the through-holes 12*c* of the insulation element 12, and thereby prevent detachment of the coil springs 14 from the insulation element 12. Further, the coil springs 14 do not come out from the insulation element 12 easily, since, when they have been inserted in the through-holes 12, friction is produced through the contact of the outer peripheries of the coil springs 14 and the inner walls.

Next, a detailed description of actions at the time when the electrical connection device according to the invention is installed will be given with reference to FIGS. 1 and 4. First, the electrical connection device 10 is press-fitted in the holding section 40*a* of the LCD holder 40 (see FIG. 2). This electrical connection device 10 can easily be inserted into the holding section 40*a*, since, as noted above, the insulation element 12 and coil springs 14 possess flexibility. At this time, when the electrical connection device 10 is inserted, the retention portions 12*a* are allowed to pass through by the holding section 40*a* of the LCD holder 40, and the device is inserted until the peripheral edge portion of the holding section 40*a* is contacted by the retention portion 12*b* shown in FIG. 2. As a result of this, the retention portions 12*a* and the retention portion 12*b* are retained by the holding section 40*a* [sic], and the insulation element 12 is mounted on the LCD holder 40.

The LCD holder 40 on which the electrical connection device 10 has been thus mounted is mounted on the circuit substrate 30. Having had the electrical connection device 10 and LCD holder 40 mounted thereon, the circuit substrate 30 is fitted in the case 50 (see FIG. 1). When all the parts are fitted in the case 50, they are installed in a state in which the circuit substrate 30 and speaker 20 are in contact with opposite ends of the electrical connection device 10, as shown in FIG. 4(*b*). Therefore, if the case 50 is subjected to impact such as that of vibration, etc. from the exterior, the impact is absorbed by the insulation element 12 made of soft resin, as indicated by the dashed lines in FIG. 4(*b*).

Thus, with the electrical connection device according to the invention the phenomenon of chattering of the coil springs 14 contacting the terminal portions 30*a* of the circuit substrate 30 and the terminal portions 20*a* of the speaker 20 can be prevented, since, if impact such as that of vibration, etc. is imposed from the exterior, it is absorbed by the insulation element 12.

Figure 6:
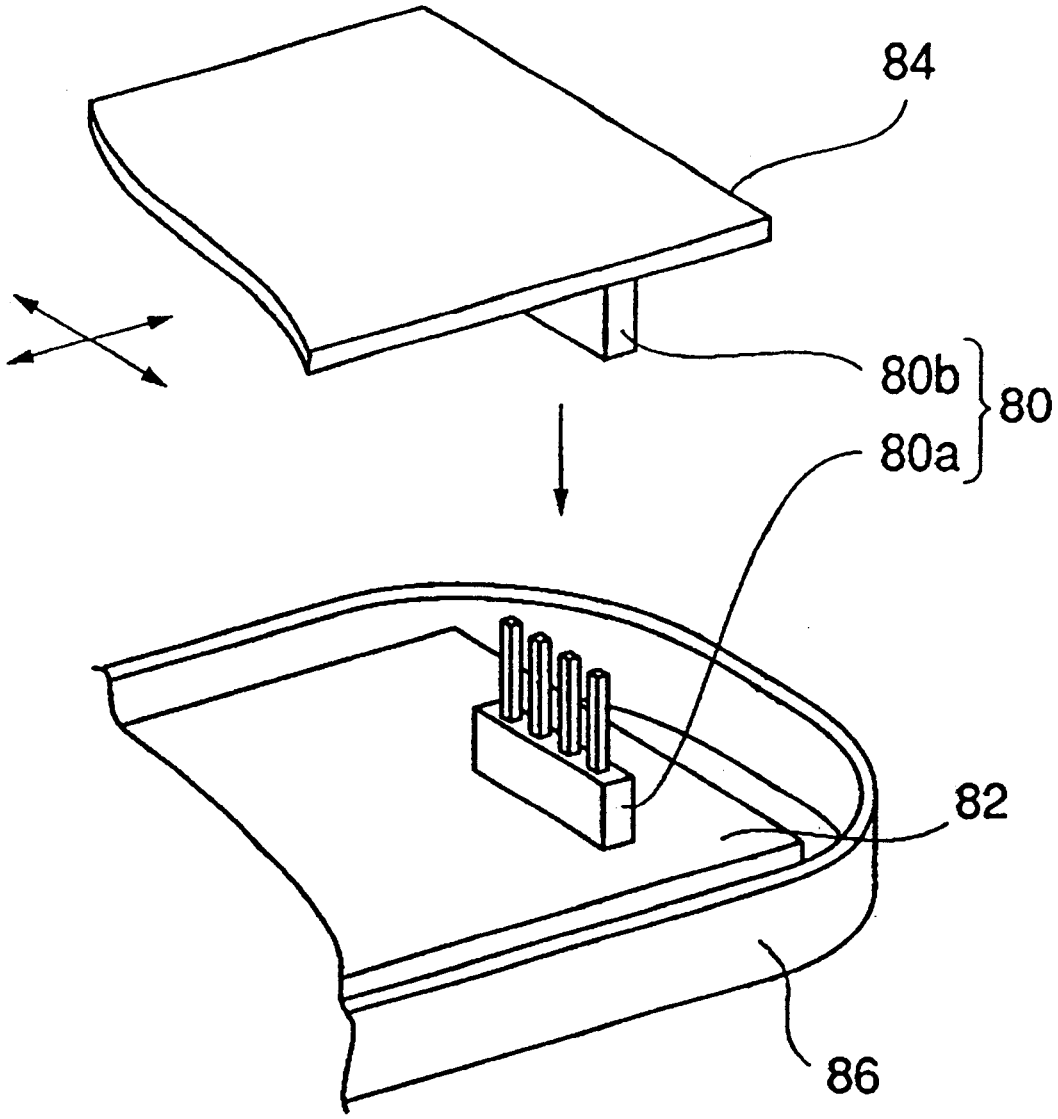
FIG. 6 PRIOR ART
FIG. 6 is a perspective view showing an electrical connection device in which conventional connectors are used.
Figure 7:
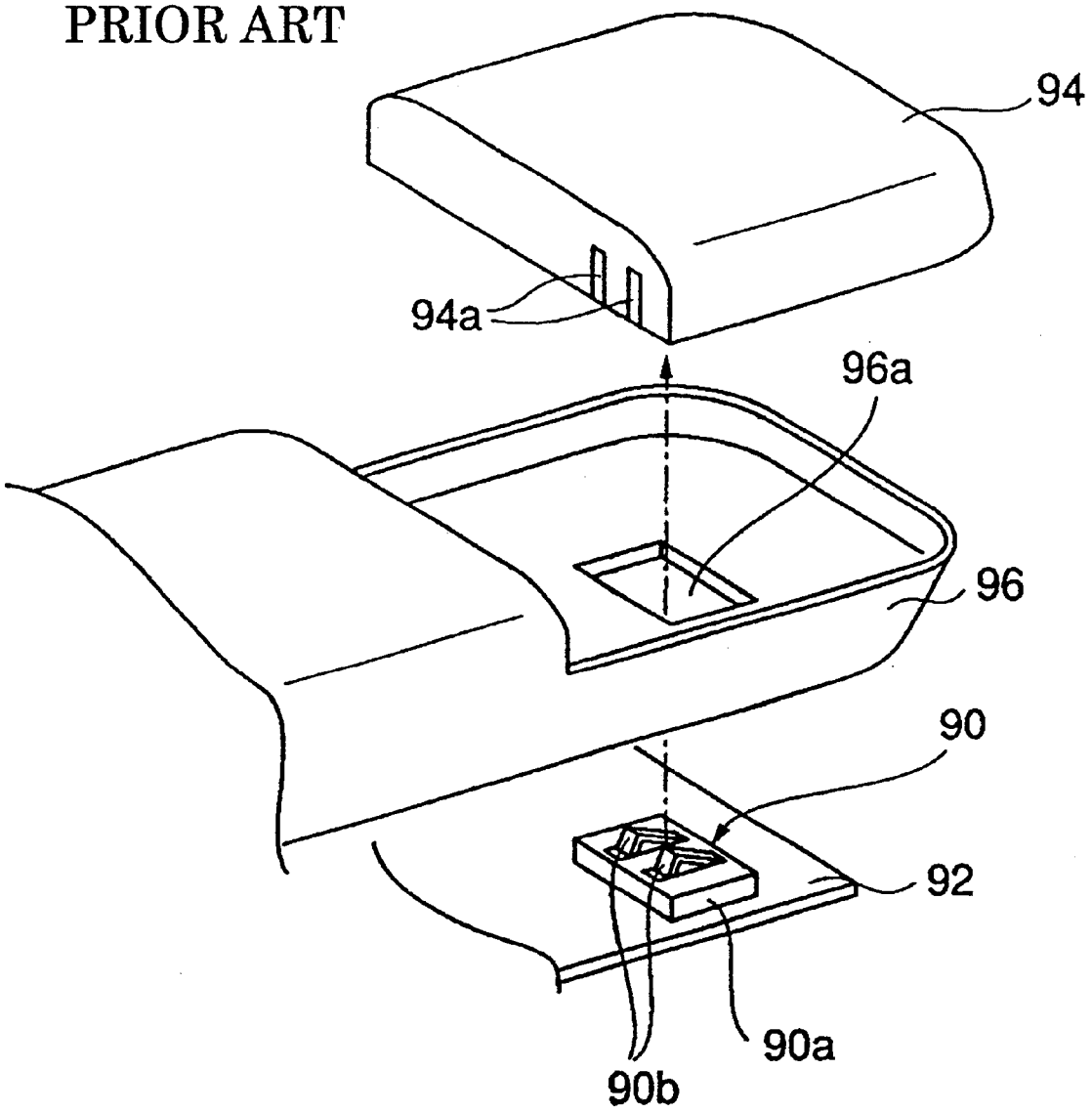
FIG. 7 PRIOR ART
FIG. 7 is a perspective view showing a conventional electrical connection device in which resilient elements in the form of connection terminals are used.
Figure 8:
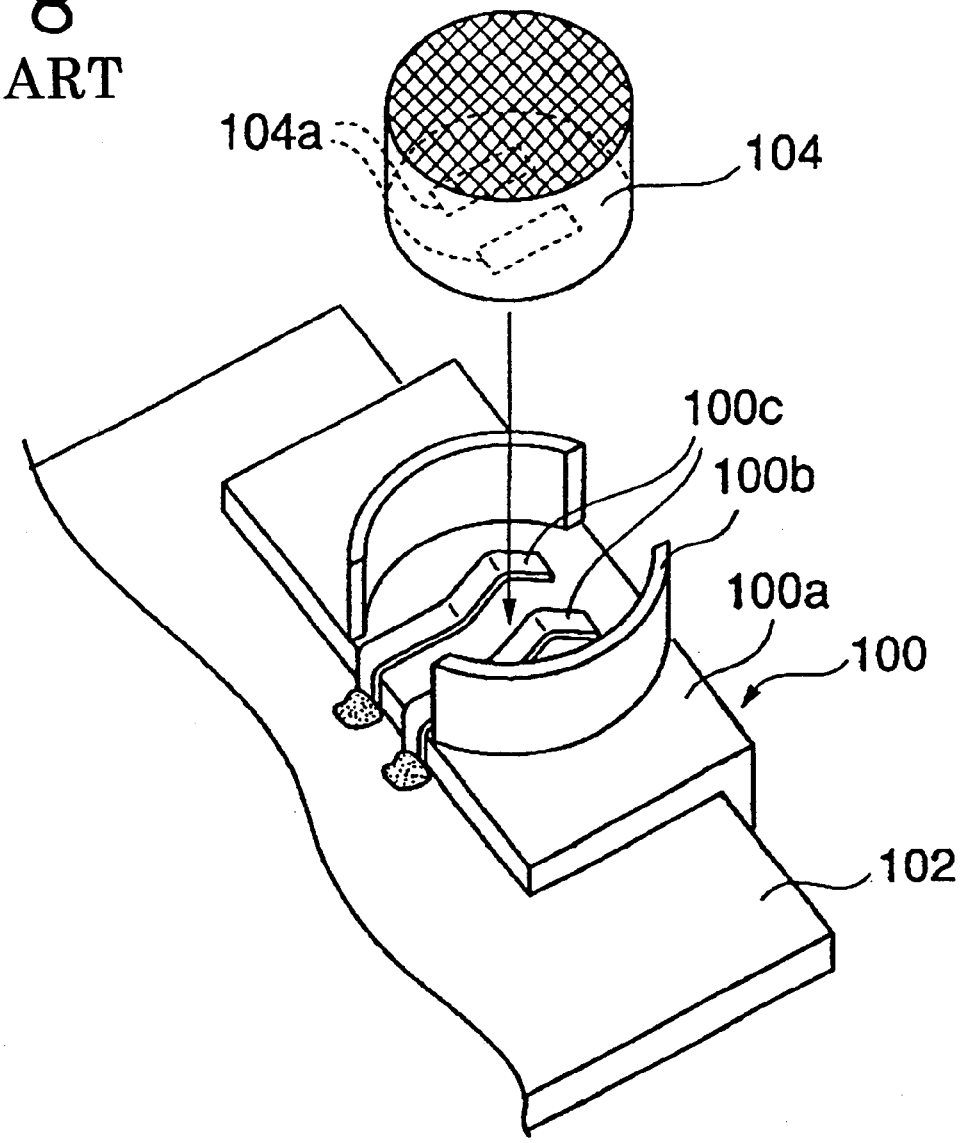
FIG. 8 PRIOR ART
FIG. 8 is a perspective view showing another conventional electrical connection device in which resilient elements in the form of connection terminals are used.
Figure 9:
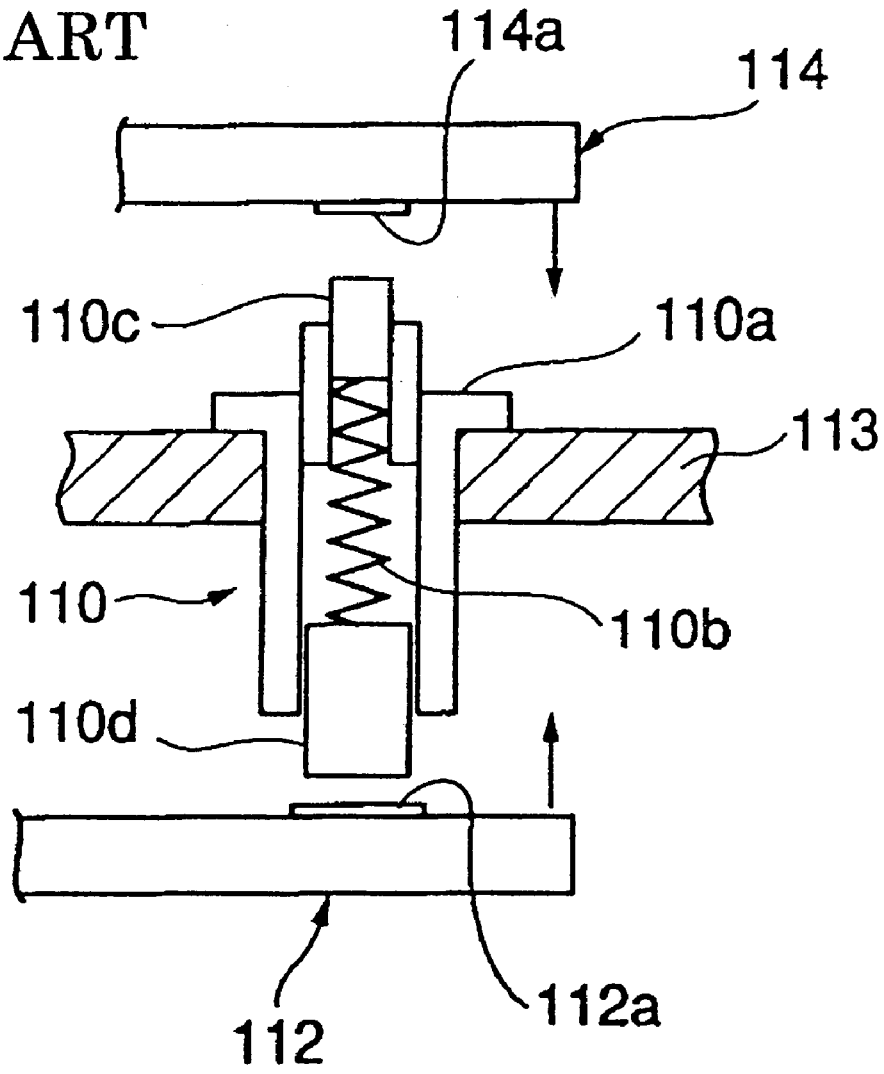
FIG. 9 PRIOR ART
FIG. 9 is a perspective view showing a conventional electrical connection device in which resilient elements constituted by coil springs are used.
Figure 10:
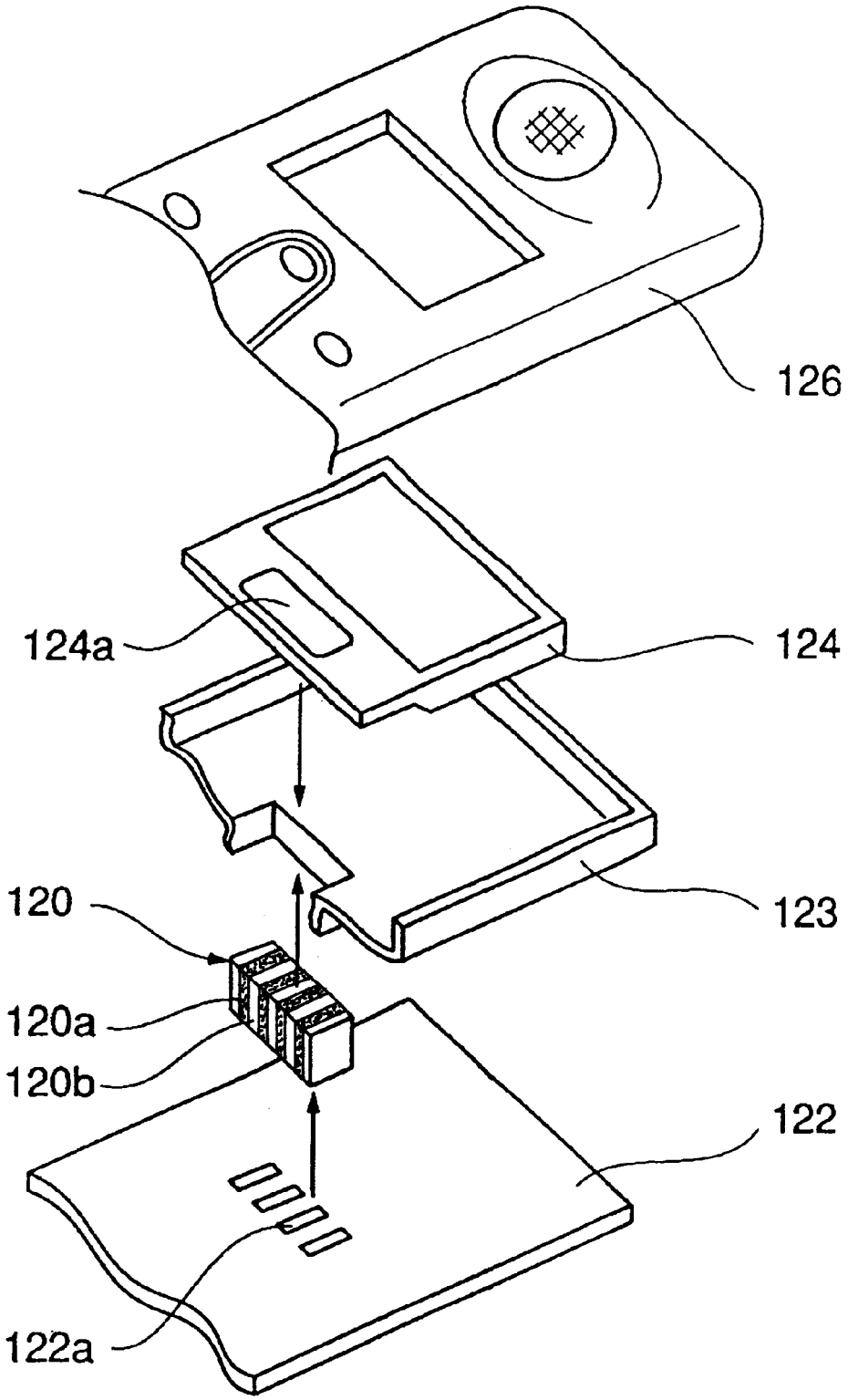
FIG. 10 PRIOR ART
FIG. 10 is a perspective view showing a conventional electrical connection device which uses a resilient element in which electrically conductive portions and resilient portions are stacked.

Although a form of implementation in which a pair of coil springs 14 is passed through and held by the insulation element has been shown in FIGS. 1–4, it is also possible to array a plurality of coil springs in the insulation element. FIG. 5 shows perspective views in illustration of other forms of implementation of the electrical connection device according to the invention, FIG. 5(*a*) showing an electrical connection device 60 in which plural coil springs are disposed in a straight line, and FIG. 6(*b*) an electrical connection device 70 in which plural coil springs are disposed in zigzag form.

As shown in FIG. 5(*a*), in the electrical connection device 60, plural coil springs 64 pass through and are held disposed in a straight line at the upper surface of an insulation element 62. This electrical connection device 60 makes it possible for the installation space of the interval C indicated in FIG.

5(*a*) to be made minimum when the plural coil springs are installed in an electronic instrument.

With the electrical connection device 70, as shown in FIG. 5(*b*), plural coil springs 74 are passed through and are held arrayed in two rows and disposed in zigzag form at the upper surface of an insulation element 72. With this electrical connection device 70, since the plural coil springs are disposed in zigzag form the installation space of the interval D indicated in FIG. 5(*b*) can be made minimum at the time of installation in an electronic instrument.

With these other forms, thus constituted, of implementation of the electrical connection device according to the invention, since the installation space can be made minimum at the time of installation of plural coil springs in an electronic instrument, it is possible to make the electronic instrument flatter, in addition to which the assembly work stage can be performed easily and it is therefore possible to improve production efficiency.

Although forms of implementation of the electrical connection device according to the invention and electronic instruments using it have been described in detail above, the invention is not limited to the abovedescribed forms of implementation, but modifications are possible within a range in which there is no departure from the essence thereof.

For example, although forms of implementation in which the electrical connection device according to the invention is used for a portable mobile telephone have been described, there is no restriction to this, but the device may also be employed for electronic instruments such as mobile communications terminals and remote units (remote computing), etc.

Further, although forms of implementation in which the electrical connection device according to the invention is used for speaker connection portions, there is no restriction to this, but the device can also be employed for electronic parts such as, eg, subsidiary substrates, power supplies, display units and switches, etc.

Thus, with the electrical connection device according to the invention and an electronic instrument using it, since the structure is one in which the terminal portions of a 1st electronic part and a 2nd electronic part are electrically connected by conductors which are in coil form and possess resilience, and these conductors are brought into contact with the 1st electronic part and 2nd electronic part while held by an insulation element made of soft resin, even if the main body of an electronic instrument is subjected to impact such as that of vibration, etc. from the exterior, the impact is absorbed by the insulation element, and it is therefore possible to prevent the phenomenon of chattering of electrical connection portions.

Also, with the electrical connection device according to the invention since the structure is a simple one in which conductors which are in coil form and possess resilience are fitted in an insulation element made of soft resin, the shape can easily be made compact and it is possible to achieve lowering of the profile of an electronic instrument main body.

Further, since the electrical connection device according to the invention possesses a simple structure as described above, a great reduction of manufacturing costs is possible, and a low-cost electrical connection device which is ideal for electrical connections can be produced.

What is claimed is:

1. An electric connection device for electrically connecting a terminal portion of a first electric part with a terminal portion of a second electric part, said electric connection device comprising:

an insulation element, having a hole therein, and a projection extending from a sidewall of the hole, said insulation element being adapted to be press-fitted with a holding member; and a coil shaped resilient conductor element having first and second ends which extend from either side of the hole, wherein said coil shaped resilient conductor element is movably engaged by the projection of the sidewall of the hole to prevent detachment of said coil shaped resilient conductor element from said insulation element, wherein said first end of said coil shaped resilient conductor element can be pressed against the terminal portion of the first electric part and said second end of said coil shaped resilient conductor element can be pressed against the terminal portion of the second electric part, and wherein said insulation element is made from soft resin so that vibration is absorbed when said coil shaped resilient conductor element contacts the first and second electric parts.

2. An electric connection device as claimed in claim 1, wherein the first electric part is a circuit board and the second electric part is an electric part.

3. An electric connection device as claimed in claim 1, wherein said holding member is a portion of a holder which holds electric parts, and wherein portion of the holder is formed in a manner to be extended from the holder.

4. An electric connection device as claimed in claim 1, wherein a plurality of said coil shaped resilient conduct elements extend through corresponding holes of said insulation element and each coil shaped resilient conductor element is movably engaged by a projection on the sidewall of a corresponding hole.

5. An electric connection device as claimed in claim 4, wherein said plurality of said coil shaped resilient conductor elements are disposed in a zigzag form relative to said insulation element.

6. An electric connection device as claimed in claim 1, wherein said plurality of said coil shaped resilient conductor elements are disposed in a straight line form relative to said insulation element.

7. An electric device comprising:

a first electric part;

a second electric part; and an electric connection device for electrically connecting a terminal portion of the first electric part with a terminal portion of the second electric part, wherein said electric connection device comprises:

an insulation element, having a hole therein, and a projection extending from a sidewall of the hole said insulation element being adapted to be press-fitted with a holding member, and a coil shaped resilient conductor element having first and second ends which extend from either side of the hole, wherein said coil shaped resilient conductor element is movably engaged by the projection on the sidewall of the hole to prevent detachment of said coil shaped resilient conductor elements from said insulation element, wherein said first end of said coil shaped resilient conductor element is pressed against the terminal portion of the first electric part and said second end of said coil shaped resilient conductor element is pressed against the terminal portion of the second electric part, and wherein said insulation element is made from soft resin so that vibration is absorbed when said coil shaped resilient conductor element contacts the first and second electric parts.

8. An electric device as claimed in claim 7, wherein said electric device is a mobile communication terminal device.

9. An electric device as claimed in claim 7, wherein the first electric part is a circuit board and the second electric part is an electric part.

10. An electric device as claimed in claim 7, wherein said holding member is a portion of a holder which holds electric parts, and wherein said portion of the holder is formed in a manner to be extended from the holder.

11. An electric device as claimed in claim 7, wherein a plurality of said coil shaped resilient conductor elements extend through corresponding holes of said insulation element and each coil shaped resilient conductor element is movably engaged by a projection on the sidewall of a corresponding hole.

* * * * *